US008270855B2

(12) United States Patent
Yagi et al.

(10) Patent No.: US 8,270,855 B2
(45) Date of Patent: Sep. 18, 2012

(54) IMAGE FORMING APPARATUS

(75) Inventors: Yasutaka Yagi, Mishima (JP); Tomoaki Nakai, Numazu (JP); Hiroyuki Seki, Mishima (JP); Kazuhiro Funatani, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 273 days.

(21) Appl. No.: 12/818,080

(22) Filed: Jun. 17, 2010

(65) Prior Publication Data

US 2010/0322643 A1 Dec. 23, 2010

(30) Foreign Application Priority Data

Jun. 23, 2009 (JP) ..... 2009-149065

(51) Int. Cl.
*G03G 15/08* (2006.01)

(52) U.S. Cl. ..... 399/27; 399/61

(58) Field of Classification Search ..... 399/9, 24–30, 399/53, 58–61, 302, 308
See application file for complete search history.

(56) References Cited

U.S. PATENT DOCUMENTS 6,667,140 B2 * 12/2003 Tosaka et al. ..... 430/108.23
6,985,678 B2 * 1/2006 Maebashi et al. ..... 399/39
7,711,274 B2 * 5/2010 Zaima ..... 399/24

FOREIGN PATENT DOCUMENTS

JP 01-134485 A 5/1989
JP 5-45994 A 2/1993
JP 2001-125400 A 5/2001
JP 2008-216702 A 9/2008

* cited by examiner

*Primary Examiner* — Hoan Tran
(74) *Attorney, Agent, or Firm* — Canon USA, Inc., IP Division

(57) ABSTRACT

An image forming apparatus is provided that includes a detection unit to detect a measure of consumption of a second cartridge. A difference between toner amounts is acquired by subtracting a toner amount per unit area of a toner image corresponding to a maximum density image formed on a first image bearing member from a toner amount per unit area of a toner image corresponding to a maximum density image formed on a second image bearing member. When the detection unit detects a second measure of consumption that is in a consumed state more than a first measure of consumption, a control unit controls a first toner forming unit and a second toner forming unit so that a difference between toner amounts is greater than when the detection unit detects the first measure of consumption.

6 Claims, 10 Drawing Sheets

IMAGE FORMING APPARATUS

BACKGROUND OF THE INVENTION

1. Field of the Invention

The present invention relates to an image forming apparatus such as a copying machine and a printer that employs an electrophotographic method.

2. Description of the Related Art

In recent years, an image forming apparatus which employs an electrophotographic method to form a color image has been widely used. Such a color image forming apparatus is further divided to various methods. For example, there is a method in which a toner image of each color is sequentially superposed on one another and transferred to an intermediate transfer member. The toner images on the intermediate transfer member are then collectively transferred to a transfer material (e.g., a paper sheet or a transparent film). Further, there is a method in which a toner image of each color is sequentially superposed on one another and transferred to a transfer material carried on a transfer material conveyance member. An endless belt is often used as the intermediate transfer member and the transfer material conveyance member (hereinafter referred to as an intermediate transfer belt and a conveyance belt respectively).

An in-line type image forming apparatus transfers toner images from a plurality of image bearing members arranged in a line to the intermediate transfer belt. The in-line type image forming apparatus takes into account a retransfer phenomenon in which a portion of the toner image previously transferred to the intermediate transfer belt is retransferred to the image bearing member in the transfer process. Further, the in-line type image forming apparatus takes into account a difference between transfer efficiencies of toners of each color generated in the transfer process.

When the image forming apparatus forms a secondary color image by superposing two colors, if the difference between the transfer efficiency of each color toner is not appropriately taken into account, it may generate density unevenness. Density unevenness is a phenomenon in which the color of the toner image transferred to the transfer material becomes different from the predetermined color. The density unevenness is caused by the transfer efficiency of the toner image of a second color becoming lower than the transfer efficiency of the toner image of a first color. When the toner image of the first color is transferred to the intermediate transfer belt, the charge amount of negative polarity on the intermediate transfer belt is increased, thus the transfer efficiency of the toner image of the second color is lowered. More specifically, if the charge amount of negative polarity on the intermediate transfer belt is large, an electric field that repels the positive electric field for transferring the second color toner to the belt becomes large. As a result, the transfer efficiency of the second color toner may be lowered. In particular, if the image forming apparatus forms a secondary color image of maximum density, a large amount of the first color toner is transferred to the intermediate transfer belt, so that the charge amount of negative polarity on the belt becomes large. The transfer efficiency of the second color toner then becomes lowered to cause density unevenness.

Japanese Patent Application Laid-Open No. 5-45994 discusses a configuration which transfers a greater amount of the second color toner (i.e. an amount of the toner formed on a photosensitive drum) as compared to the amount of the first color toner. The toner amount of the second color to be transferred to the intermediate transfer belt is increased to compensate for lowering of the transfer efficiency of the second color and thus to reduce occurrence of the density unevenness.

However, the technique discussed in Japanese Patent Application Laid-Open No. 5-45994 does not resolve deterioration itself of the transfer efficiency of the second color and subsequent ones. As a result, a consumed amount of the toner increases according to the technique discussed in Japanese Patent Application Laid-Open No. 5-45994.

SUMMARY OF THE INVENTION

The present invention is directed to a technique that can suppress deterioration of a transfer efficiency of a second color and reduce density unevenness without causing a toner consumed amount to increase.

According to an aspect of the present invention, an image forming apparatus which can detachably mount a cartridge that includes at least an image bearing member configured to bear a toner image and a first toner forming unit configured to form the toner image on the image bearing member therewith includes a rotatable intermediate transfer belt, a first cartridge which includes at least a first image bearing member configured to bear a toner image and the first toner forming unit configured to form the toner image on the first image bearing member, a second cartridge which includes at least a second image bearing member configured to bear a toner image and a second toner forming unit configured to form the toner image on the second image bearing member, and a control unit configured to control the first toner forming unit and the second toner forming unit to control a toner amount per unit area of a toner image corresponding to a maximum density image respectively formed on the first image bearing member and the second image bearing member, wherein the toner image from the second image bearing member is transferred onto the toner image transferred from the first image bearing member to the intermediate transfer belt, and the toner images superposed on the intermediate transfer belt is transferred to a transfer material, wherein the image forming apparatus further includes a detection unit configured to detect a measure of consumption of the second cartridge, and wherein the control unit controls, when the measure of consumption detected by the detection unit is a second measure of consumption which is in a consumed state more than a first measure of consumption, the first toner forming unit and the second toner forming unit so that a difference in a toner amount acquired by subtracting the toner amount per unit area of the toner image corresponding to the maximum density image formed on the first image bearing member from the toner amount per unit area of the toner image corresponding to the maximum density image formed on the second image bearing member becomes greater than a difference between the toner amounts those of when a detected measure of consumption is the first measure of consumption.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

A first exemplary embodiment according to the present invention will be described in detail below wither reference to the drawings.

Figure 1:
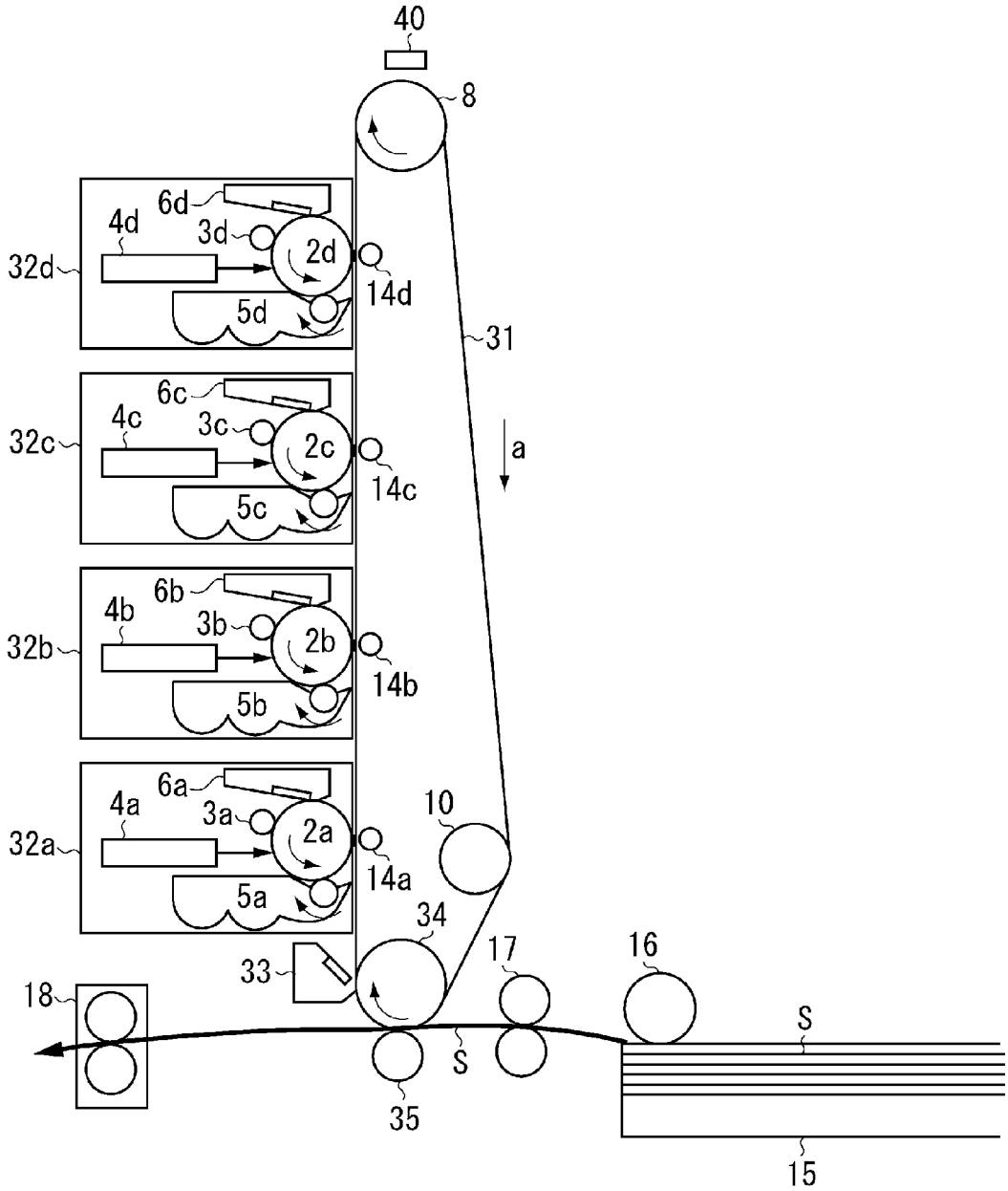
FIG. 1 illustrates an example of a cross sectional view of an image forming apparatus according to the present invention.

FIG. 1 illustrates a cross sectional view of an example of a color image forming apparatus employing an electrophotographic process according to the present exemplary embodiment.

Referring to FIG. 1, a process cartridge 32 (32*a*, 32*b*, 32*c*, and 32*d*) is detachably attached to an apparatus main body and aligned in a vertical direction. The process cartridge 32 (32*a*, 32*b*, 32*c*, and 32*d*) at least includes a photosensitive drum 2 (2*a*, 2*b*, 2*c*, and 2*d*) and a developing unit 5 (5*a*, 5*b*, 5*c*, and 5*d*) that develops a toner image on each of the respective photosensitive drums 2. The photosensitive drum is an image bearing member that bears a toner image.

Further, each of the process cartridges 32 includes a charging unit 3 (3*a*, 3*b*, 3*c*, and 3*d*) that charges the respective photosensitive drum, and an exposure unit 4 (4*a*, 4*b*, 4*c*, and 4*d*) that exposes the respective photosensitive drum and forms an electrostatic latent image. Furthermore, the process cartridge 32 according to the present exemplary embodiment includes a cleaning member 6 that removes residual toner remaining on the photosensitive drum 2. The developing unit 5, the charging unit 3, and the exposure unit 4 configure a toner forming unit that forms a toner image on the photosensitive drum.

The image forming apparatus is configured to acquire a full color image by sequentially superposing and transferring each toner image of different color formed in the process cartridge (i.e. image forming station) 32 to an intermediate transfer belt 31 and then collectively transferring the superposed color images to a transfer material S. The intermediate transfer belt 31 is a movable intermediate transfer member. The transfer material S is fed from a sheet feeding unit 15 and discharged to a sheet discharge tray (not illustrated).

The photosensitive drum 2, i.e. an image bearing member, is a rotational drum type electrophotographic photosensitive member to be repeatedly used. The photosensitive drum 2 is rotationally driven at a predetermined peripheral speed (i.e. process speed). The photosensitive drum 2 is uniformly charged by the charging roller 3, i.e. the charging unit, to a predetermined polarity and potential (of a negative charge according to the present exemplary embodiment). Each photosensitive drum 2 is then exposed by the exposure unit 4 (configured by a laser diode, a polygon scanner, a lens group, and so on). The electrostatic latent images corresponding to each of a first, second, third, and fourth color component images (yellow, magenta, cyan, and black component images according to the present exemplary embodiment) are thus formed.

The developing unit 5 then develops the electrostatic image by adhering a toner, i.e. a developer, to the electrostatic latent image formed on the photosensitive drum 2. The developing unit 5 includes a toner container that contains a toner, a developing roller (developing member) 58, i.e. a developer bearing member that bears and conveys the toner, and a developing blade 51 that regulates a toner amount on the developing roller. The developing roller 5 is rotatable.

Figure 10:
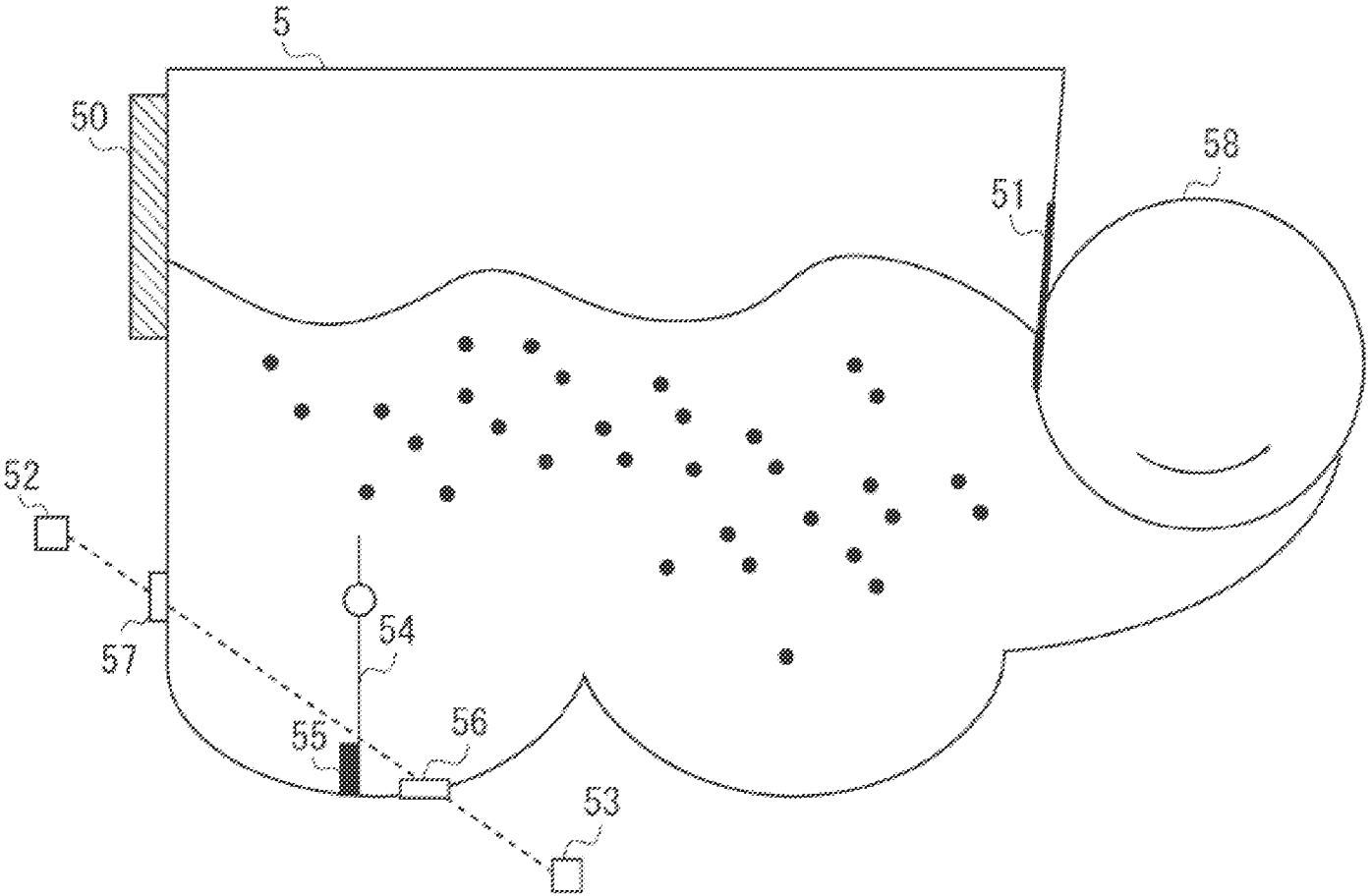
FIG. 10 illustrates a developing unit.

FIG. 10 illustrates the developing roller 58 and the developing blade 51. The developing roller 58 is formed of an elastic rubber whose resistance is adjusted. The developing roller 58 rotates in a forward direction with respect to the photosensitive drum 2 and is disposed to be in contact with the photosensitive drum 2. The developing roller 58 is applied a high voltage of a predetermined polarity (a negative polarity according to the present exemplary embodiment). The developing blade 51 is pressed onto the developing roller 58 at a predetermined pressing force. Accordingly, the toner (having a negative charge polarity according to the present exemplary embodiment) carried on the developing roller 58 which is frictionally charged to the same polarity in each developing unit is transferred to the photosensitive drum 2 and thus developed. The toner forming unit configured by the developing unit 5, the charging unit 3, and the exposure unit 4 can form a desired amount of toner on the photosensitive drum 2 by changing each potential (i.e. a developing potential, a charging potential, and an exposure potential).

Referring to FIG. 1, a primary transfer member 14 disposed facing the photosensitive drum 2 via the intermediate transfer belt 31 primary transfers each color toner image developed on the photosensitive drum 2. According to FIG. 1, the primary transfer member 14 primary transfers the color toner image. However, other methods may be used in performing primary transfer. Each of the different color toner images is primary transferred from the photosensitive drum 2 to the intermediate transfer belt 31 by static electricity (of a positive charge according to the present exemplary embodiment) generated by a high voltage applied to the primary transfer roller 14. The primary transfer roller 14 is a foam rubber roller whose resistance is adjusted to 106Ω to 109 Ω.

The intermediate transfer belt 31 is an endless belt which is movable by an operation of a drive roller 8. During the image forming process, the intermediate transfer belt 31 which is in contact with the photosensitive drum 2 moves at a moving speed that is approximately the same as the rotational speed of the photosensitive drum 2.

The intermediate transfer belt 31 is formed of an endless film member having 50 μm to 150 μm thickness and 108 to 1012 Ω*cm volume resistivity. A cleaning blade 6 removes and collects primary transfer residual toner remaining on the photosensitive drum 2 after the toner image is transferred from the photosensitive drum 2 to the intermediate transfer belt 31.

A registration roller pair 17 which is rotatably driven at predetermined timing conveys the transfer member S fed from the sheet feeding unit 15 to a nip portion between the intermediate transfer belt 31 and a secondary transfer roller 35. The toner image on the intermediate transfer belt 31 is then transferred to the transfer member S by static electricity (of a positive charge according to the present exemplary embodiment) generated by a high voltage applied to the secondary transfer roller 35. The secondary transfer roller 35 is a foam rubber roller whose resistance is adjusted to 107Ω to 109 Ω.

A fixing device 18 fixes the toner image onto the transfer material S by applying heat and pressure, and then the transfer material S is discharged to outside the apparatus (i.e. outside the image forming apparatus main body). A cleaning blade 33 serving as a cleaning unit removes and collects second transfer residual toner remaining on the intermediate transfer belt 31 after the toner image is transferred from the intermediate transfer belt 31 to the transfer material S.

The amount of toner formed on the photosensitive drum 2 by the toner forming unit in the above described image forming apparatus will be referred to as a toner mounting amount.

The toner mounting amount ($mg/cm^2$) is the weight of the toner per unit area of the toner image developed on the photosensitive drum 2. A toner mounting amount M ($mg/cm^2$) is measured by sucking and peeling off the toner developed on the drum before performing primary transfer and directly measuring the weight (mg) using an electronic scale or the like. The measured weight is then normalized by an area S ($cm^2$) from which the toner is peeled off, so that the mounting amount ($mg/cm^2$) is acquired. A maximum density image is an image with a maximum density gradation level that the image forming apparatus can form. The image forming apparatus reduces the toner mounting amount according to a gradation from a toner mounting amount M of the maximum density image as the maximum value of the mounting amount.

The density unevenness is often generated when the image forming apparatus forms the maximum density image using the secondary color acquired by superposing two colors. The density unevenness generated when the image forming apparatus forms a solid green image using the photosensitive drum 2*a* (i.e. a first image bearing member) that bears a yellow toner image and the photosensitive drum 2*c* (i.e. a second image bearing member) that bears a cyan toner image will be described below as an example. The toner forming unit which forms the toner image on the photosensitive drum 2*a* (the first image bearing member) will be referred to as a first toner forming unit. The toner forming unit which forms the toner image on the photosensitive drum 2*c* (the second image bearing member) will be referred to as a second toner forming unit.

The photosensitive drum 2*a* is disposed on an upstream side of a moving direction of the intermediate transfer belt 31 with respect to the photosensitive drum 2*c*. Hereinafter, the yellow toner transferred from the photosensitive drum 2*a* (the first image bearing member) will be referred to as a first color toner. Further, the cyan toner transferred from the photosensitive drum 2*c* (the second image bearing member) will be referred to as a second color toner.

When the image forming apparatus forms the maximum density image of the secondary color, the toner mounting amount of the toner image developed on the first image bearing member is the maximum mounting amount. A large amount of toner is thus transferred from the first image bearing member to the intermediate transfer belt 31.

For example, when the image forming apparatus forms the maximum density image of a green color, i.e. the secondary color, it is necessary to transfer the cyan toner image to be superposed on the image formed with a large amount of yellow toner which is transferred to the intermediate transfer belt. If the amount of the yellow toner (i.e. the first color toner) transferred to the intermediate transfer belt is the maximum mounting amount, the total charge amount of negative polarity on the intermediate transfer belt becomes large. In such a case, since the total charge amount of negative polarity on the intermediate transfer belt is large, the electric field which repels the electric field force for primary transferring the cyan toner becomes large. As a result, an amount of the cyan toner (i.e. the second color toner) to be finally transferred to the intermediate transfer belt becomes small. In other words, the transfer efficiency of the toner from the second photosensitive drum 2*c* to the intermediate transfer belt 31 is easily lowered as compared to when the image forming apparatus forms a single color image.

Further, if the mounting amounts of the yellow toner and the cyan toner for forming the maximum density green color image are set to the same amount to acquire a maximum yellow density and a maximum cyan density respectively, the transfer efficiency of the cyan toner becomes lower than the transfer efficiency of the yellow toner. The amount of the cyan toner transferred to the intermediate transfer belt 31 thus becomes less than the amount of the yellow toner. As a result, when the image forming apparatus forms the maximum density image of the green color, i.e. the secondary color, the acquired green image contains a higher density of the yellow toner than that of the cyan toner, as compared to a desired green image. In particular, if the transfer efficiency of the cyan toner is greatly lowered as compared to the transfer efficiency of the yellow toner, the density of the yellow color becomes excessively greater than the density of the cyan color. Thus, visible density unevenness is generated in the image fixed on the transfer material.

The primary transfer efficiency of the second color toner may be improved by increasing a primary transfer voltage. However, if the primary transfer voltage is simply increased with respect to the second color toner, an abnormal discharge may be generated in a transfer nip portion. The abnormal discharge may reverse the amount of the negative charge in the first color toner on the intermediate transfer belt 31 to the positive charge, or reduce the amount of the negative charge. As a result, the first color toner becomes easily retransferred (or reverse transferred) from the intermediate transfer belt 31 to the second image bearing member, so that the density of the first color toner is harmfully affected and reduced.

Such a problem does not occur when the maximum density toner image is transferred to an entire surface of the recording material, such as a solid image. However, when the image forming apparatus forms images including both the secondary color image and the single color image, the single color image tends to become retransferred and the density there of is reduced by simply increasing the primary transfer voltage. Therefore, according to the present exemplary embodiment, the primary transfer voltage is not simply increased to transfer the secondary color toner, and the primary transfer voltage is not changed by the difference in colors.

Further, depending on consumption of each of the process cartridges, the transfer efficiency of the second color toner in the secondary color may be greatly lowered as compared to the transfer efficiency of the first color toner in the secondary color. In other words, when the process cartridge is consumed, the transfer efficiency of the second color toner in the secondary color is greatly lowered. As a result, the visible density unevenness may be easily generated in the fixed image.

Figure 2:
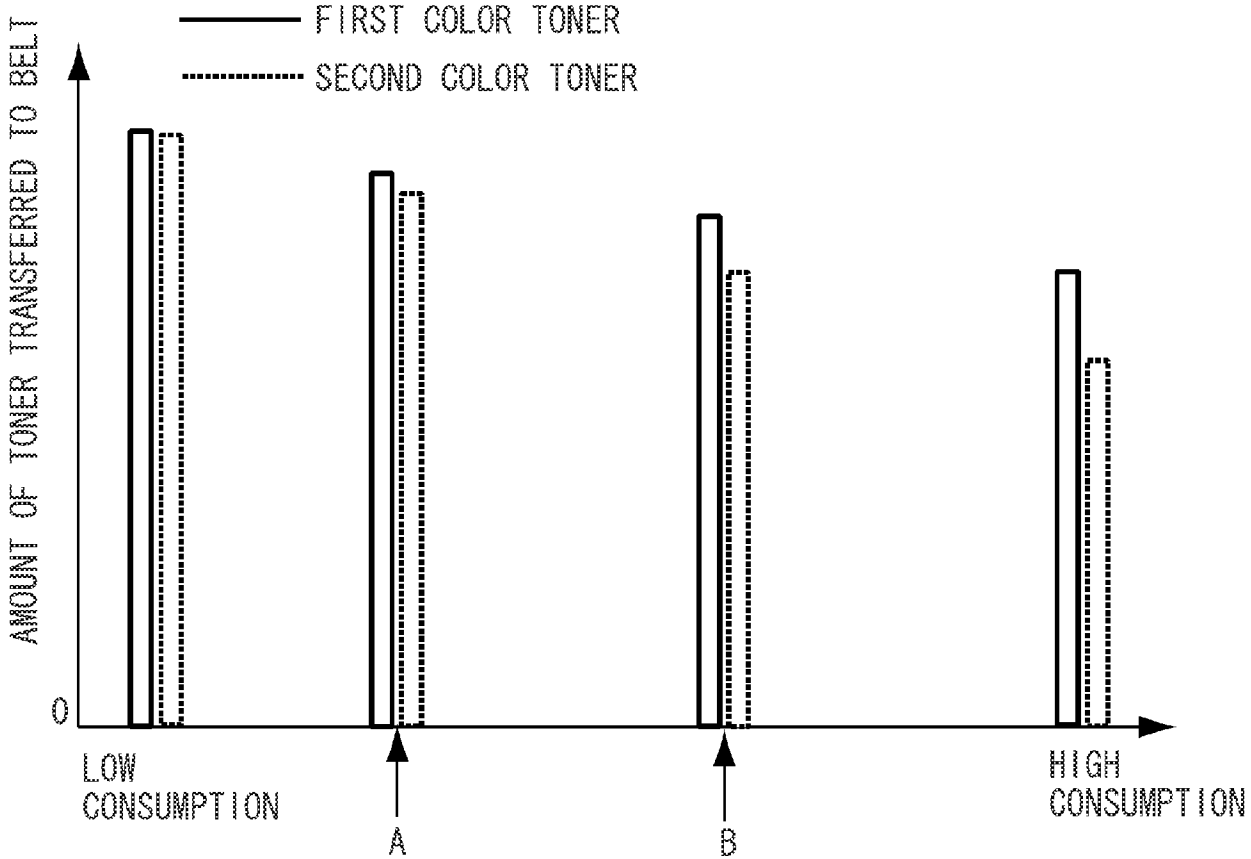
FIG. 2 illustrates a comparison between an amount of toner transferred to a belt and a degree of consumption of a cartridge.

FIG. 2 illustrates a relation between the measure of consumption of the process cartridge and the amounts of the first color toner and the second color toner transferred to the intermediate transfer belt. Referring to FIG. 2, the mounting amount of the first color toner at the maximum density and the mounting amount of the second color toner at the maximum density are the same. The measure of consumption of the process cartridge is indicated on a horizontal axis, and the consumption of the process cartridge increases in a direction indicated by an arrow. The amount of toner transferred to the intermediate transfer belt is indicated on a vertical axis. The mounting amounts of both the first color toner and the second color toner decrease as the process cartridge is consumed.

However, a difference between the amount of transferred toner of the first color toner and that of the second color is greater when the consumption of the process cartridge is high (as indicated by an arrow B illustrated in FIG. 2) as compared to when the consumption of the process cartridge is low (as indicated by an arrow A illustrated in FIG. 2). The reason why the difference in the amounts of the transferred toners is generated may be because the transfer efficiency of the second color toner is more easily lowered as compared to the transfer efficiency of the first color toner as the process cartridge becomes consumed.

In general, as the process cartridge becomes consumed, the toner in the developing unit is deteriorated. The toner deterioration indicates that the negative charge amount of the toner is decreased or becomes non-uniform. If the toners are similarly deteriorated in each of the first color and the second color process cartridges, the transfer efficiency of the second color toner to the intermediate transfer belt whose negative charge amount has increased by the transfer of the first color toner is more easily lowered than that of the first color toner.

According to the present exemplary embodiment, a difference between the transfer efficiencies of the first color toner and the second color toner when each of the process cartridges is consumed is improved. More specifically, in the present exemplary embodiment, the consumption of each of the process cartridges is detected from a cartridge life which indicates a measure of consumption of each cartridge (the cartridge life will be described below).

A control unit then uses the detection result to perform control so that the mounting amount of the first color toner in the secondary color which is set to be the maximum density becomes less than the mounting amount of the second color toner in the secondary color which is set to be the maximum density. The difference in the transfer efficiencies can thus be improved by performing such control.

Figure 3:
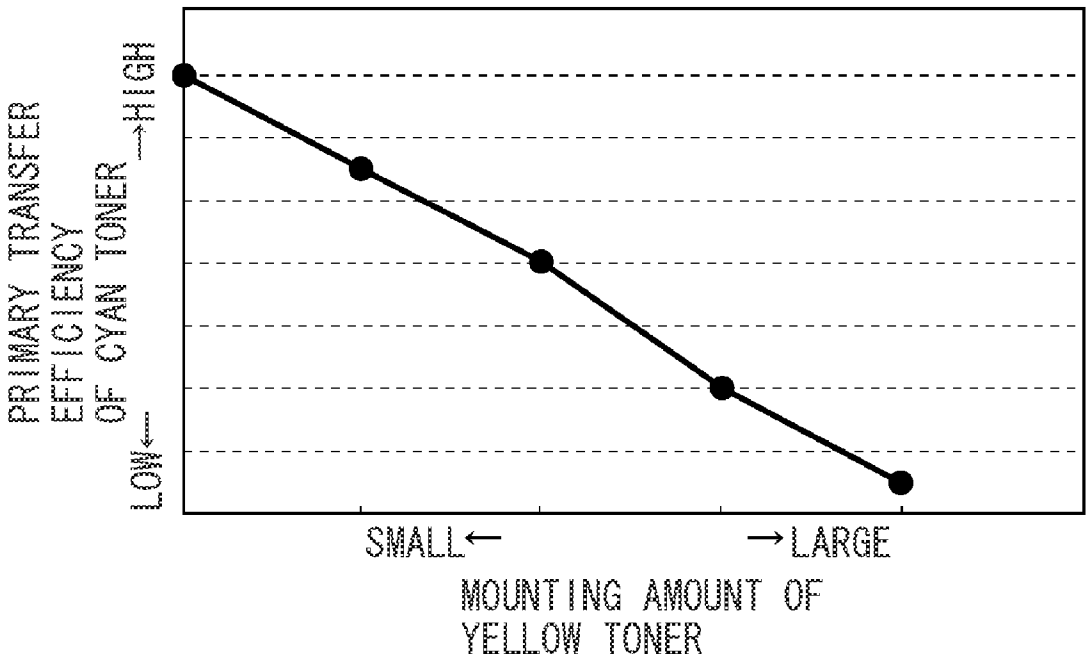
FIG. 3 illustrates a change in a transfer efficiency of a second color toner with respect to a mounting amount of a first color toner.

FIG. 3 illustrates the primary transfer efficiency of the cyan toner, i.e. the second color toner, against the mounting amount of the yellow toner, i.e. the first color toner, when the maximum density green color image is formed. Referring to FIG. 3, as the mounting amount M of the first color toner increases, the transfer efficiency of the second color toner to be superposed thereon becomes lower. In contrast, the transfer efficiency of the second color toner becomes higher as the mounting amount M of the first color toner decreases.

Figure 4:
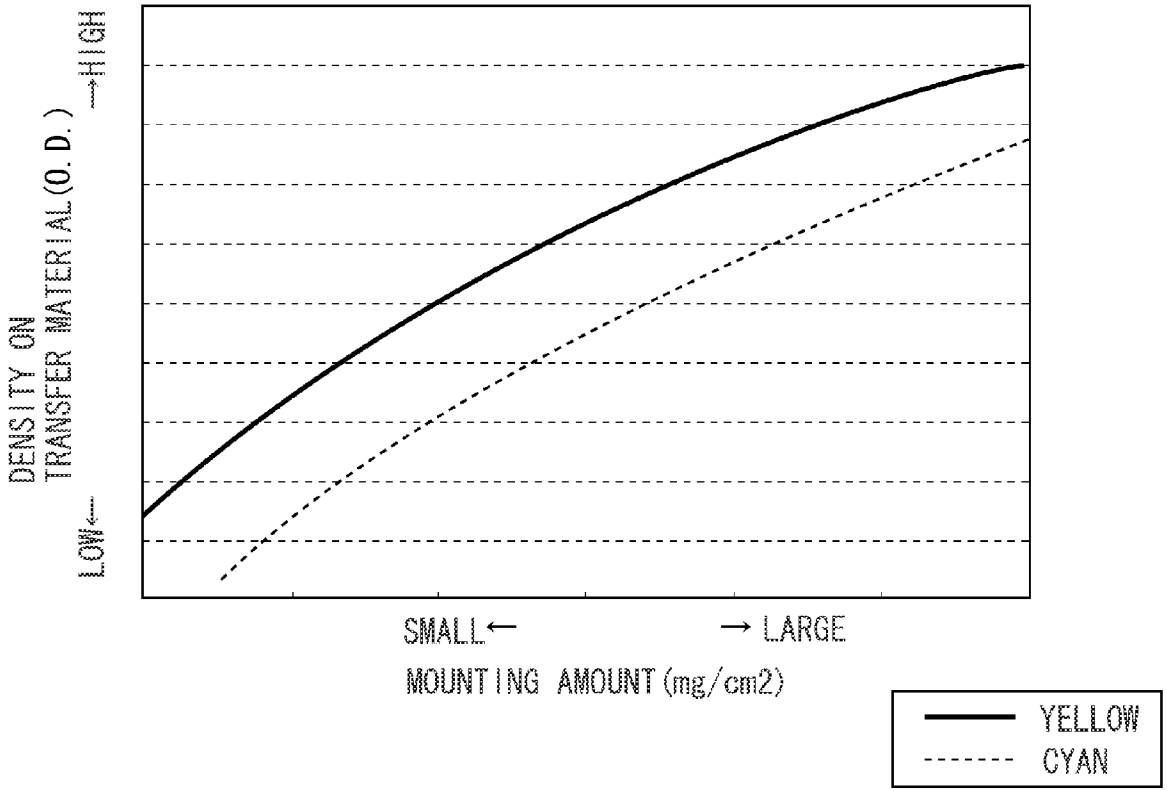
FIG. 4 illustrates a correlation between a mounting amount and reflection density for a yellow toner and a cyan toner.

Further, the density unevenness can be more effectively reduced by arranging each process cartridge so that the toner of a color having greater brightness becomes the first color toner in the secondary color. FIG. 4 illustrates a correlation between the mounting amounts of the yellow toner (i.e. the first color toner) and the cyan toner (i.e. the second color toner) and the densities thereof on the transfer material. As illustrated in FIG. 4, when the mounting amounts of the toners are the same, a reflective density of the yellow toner whose brightness is greater than the cyan toner becomes higher on the transfer material.

Therefore, if the densities of the toners on the transfer material are to be the same, the mounting amount of the yellow toner having greater brightness can be decreased as compared to the other color toners having less brightness. According to the present exemplary embodiment, the mounting amount of the yellow toner, i.e. the first color toner, is set to 80% to 90% of the mounting amount of the cyan toner, i.e. the second color toner. According to the present exemplary embodiment, the yellow toner is set as the first color toner so that the reflective density of the first color toner on the transfer material becomes the same as that of the second color toner whose mounting amount is large even when the mounting amount of the first color toner is decreased.

According to the present exemplary embodiment, the control unit controls each toner forming unit so that the mounting amount of the first color toner becomes less than the mounting amount of the second color toner. The control unit is capable of changing the developing potential and the rotation speed of each developing unit 5, the charging potential of each charging unit 3, and the exposure potential of each exposure unit 4, based on the measure of consumption of the cartridge.

Figure 5:
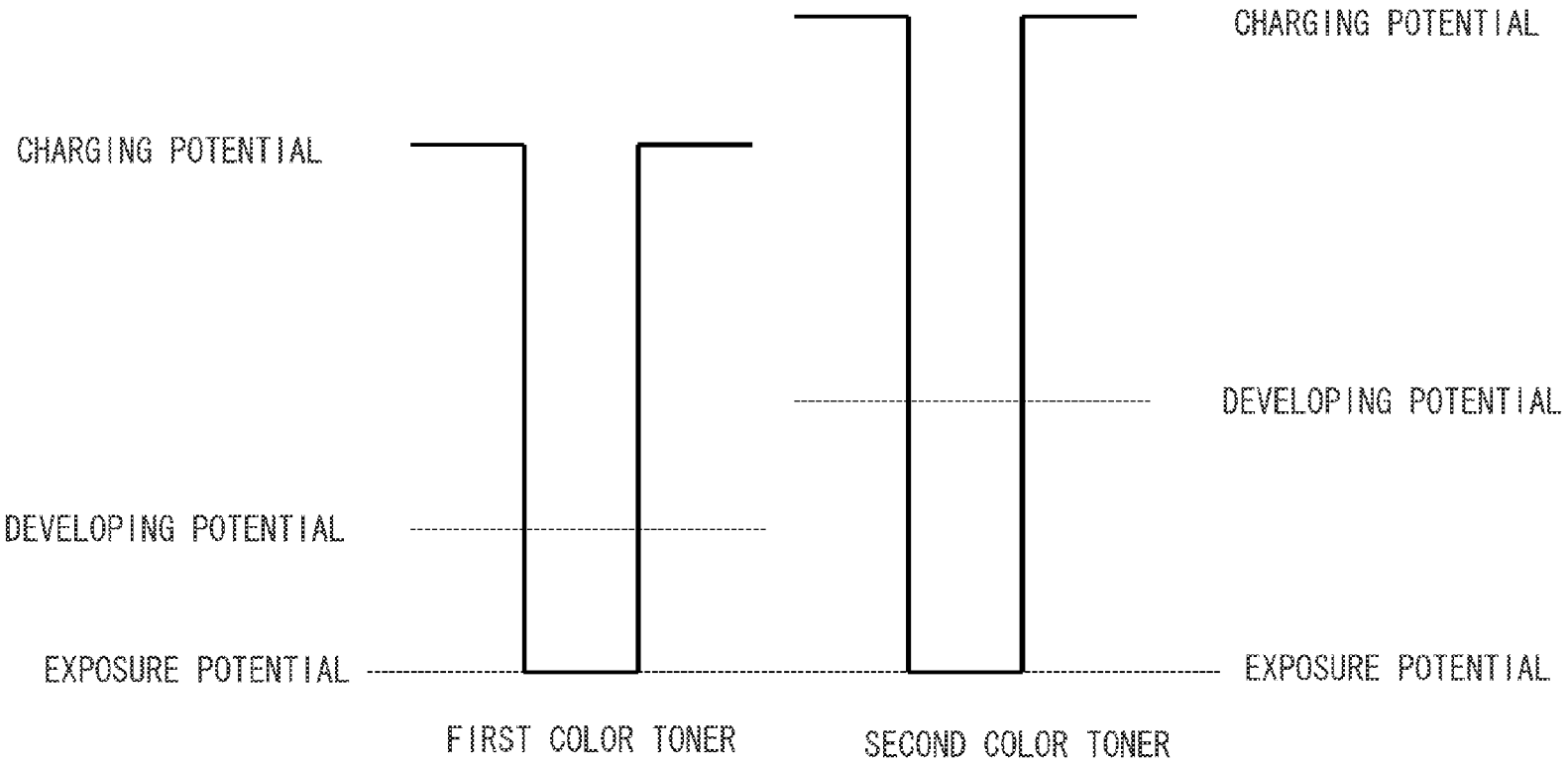
FIG. 5 illustrates each potential setting in a toner forming unit when a mounting amount is changed.

For example, a back contrast (i.e. charging potential-developing potential) and an exposure amount (i.e. an exposure potential) are fixed as illustrated in FIG. 5. A difference between the exposure potential and the developing potential of the first color toner in the secondary color is set to be smaller than setting values with respect to the second color toner.

However, the effect of the present invention is not limited to the above described method, and other methods may be used. For example, the exposure potential of the first color toner when forming the image is set to be less than the exposure potentials of the second color toner and subsequent color toner when forming the image. Further, if the exposure potential can also be controlled by a pulse width, the pulse width of the first color is reduced as compared to that of the second color and subsequent ones. Furthermore, a peripheral speed difference between the first image bearing member and the first developing unit when forming the image in the first color is reduced as compared to that of the second color and subsequent ones.

According to the above described methods, the density unevenness of the secondary color can be reduced by decreasing the mounting amount of the first color toner as compared to that of the second color and subsequent colors and enhancing the primary transfer efficiencies of the second color and subsequent colors.

The cartridge life for detecting the consumption of each process cartridge will be described below. The cartridge life is determined based on two factors. One is a state of the toner contained in the developing unit (hereinafter referred to as a toner life) and the other is a state of the developing roller 58, i.e. the developing member (hereinafter referred to as a developing member life). Since the decrease and the non-uniformity in the negative charge amount of the toner are considered to relate to the toner life and the developing member life.

Compared with when the toner life is long, as the toner life becomes short, empty space inside the toner container increases. As a result, a travel distance of the toner agitated by a predetermined agitating force inside the toner container increases. If the travel distance of the toner increases, a frequency of the toner passing through various sliding and grazing portions such as the nip portion formed between the developing roller 58 and the developing blade 51 increases. The toner thus becomes more easily deteriorated. More specifically, a resin surface of the toner base becomes deteriorated, or a charge control agent becomes peeled off. As a result, the negative charge amount of the toner is reduced or becomes non-uniform. The cartridge life is thus estimated from the toner life.

The developing member life will be described below. The toner which is regulated by the developing roller 58 and the developing blade 51 receives a physical contact damage by the rotation of the developing roller 58 and becomes deteriorated. Further, as operating time of the developing roller 58 increases by continuous use, surfaces of the developing roller 58 and the developing blade become deteriorated, or the developing roller 58 becomes soiled, so that deterioration of the toner is promoted. As a result, the negative charge amount of the toner is reduced or becomes non-uniform. The cartridge life is thus estimated from the developing member life.

The process cartridge 32 for each color includes a detection unit configured to detect the cartridge life. The toner mounting amounts of the first color toner and the second color toner are then changed based on each of the cartridge life.

Referring to FIG. 10, a storing member 50 is a non-volatile, readable and writable storing member such as an electronically erasable and programmable read-only memory (EEPROM). The storing member is disposed in the developing unit 5 of each process cartridge 32. The storage member 50 in the process cartridge 32 attached to the image forming apparatus is electrically connected to the image forming apparatus via a connector and is capable of exchanging information with the detection unit of the image forming apparatus. In other words, information in each storing member can be read and written by the detection unit. An electromagnetic coupling type readable and writable contactless memory which can transmit and receive signals in a contactless state may also be used as the storing member. Further, a non-volatile read-only memory (ROM) may be used as a storing unit according to the present exemplary embodiment.

Definition and a determination method of the developing member life will be described below. For example, the storing member (i.e. a first detection member) calculates a total number of rotations or operation time of the developing roller 58 accumulated from a brand new state, and stores the total number of rotations. When the developing roller 58 is in the brand new state, i.e. the number of rotations (operation time) to be stored in the storing member is 0,
the detection unit determines that the developing member life is 100%. When the total number of rotations stored in the storing unit reaches a predetermined threshold value SO (determined from various image failures), it is determined that the developing member life has reached the end. The detection unit then determines that the developing member life is 0%.

The detection method of the toner life is described below. According to the present exemplary embodiment, a toner remaining amount detection member (i.e. a second detecting member) uses an optical detection method to detect a remaining amount of the toner in the toner container. The detection unit then determines the toner life from the detection result. The detecting member may also detect a consumed amount of the toner. Further, the second detecting member may detect the consumed amount of the toner and then detect the remaining amount of the toner from the detection result.

Referring to FIG. 10, a light emitting unit 52 including a light emitting element that emits light, and a light receiving unit 53 including a light receiving element that receives the light (detected light) are disposed in a predetermined portion around the toner container configuring the developing unit 5. Further, windows 56 and 57 for detecting a remaining toner which are translucent windows are disposed on a light path of the toner container so that the detection light can pass through the predetermined portion of the toner container. A light detection circuit from the light emitting unit 52 to the light receiving unit via the toner container is thus configured.

A mylar sheet 55 for cleaning the windows 56 and 57 is fixed on a leading end of an agitation member 54 for agitating the toner. The mylar sheet 55 wipes the windows 56 and 57 on inner surfaces side of the toner container, in synchronization with the rotation of the agitation member 54. The light detection circuit then detects the remaining amount of the toner in the toner container based on the detection light detected by the light receiving unit 53. However, when there is a large amount of toner remaining in the toner container, the windows 56 and 57 are immediately covered with the toner even when wiped by the mylar sheet 55. Thus, the light is not transmitted through the windows, and the light receiving unit 53 cannot detect the light unless the remaining amount of the toner is a predetermined amount or greater. As the amount of toner in the toner container decreases, the detection light becomes detectable by the light receiving unit 53. The light receiving unit 53 can detect the remaining amount of the toner based on a length of the detection time as an output pulse width T. The output pulse width T is detected in the same period as that of the agitation member 54, and increases as the remaining amount of toner decreases. The detection unit determines that the toner life is 0% when the light receiving unit 53 detects a predetermined output pulse width TO.

The detection unit thus determines the cartridge life from the above described two factors, the toner life detected by the second detection member and the developing member life detected by the first detection member. More specifically, the shorter one of the two detected factors is set as the cartridge life. The cartridge life is defined as 100% when the cartridge is brand new and 0% when the cartridge reaches the end of the life. For example, if the toner life is 30% and the developing member life is 50%, the detection unit determines the cartridge life as 30%. If the toner life is 40% and the developing member life is 15%, the detection unit determines the cartridge life as 15%. The control unit may include the detection unit.

A method for changing the mounting amounts of the toners based on the cartridge life according to the present exemplary embodiment will be described below. An example in which yellow is the first color and cyan is the second color for forming the maximum density image of the green color, i.e. the secondary color, will be described below.

Figure 6:
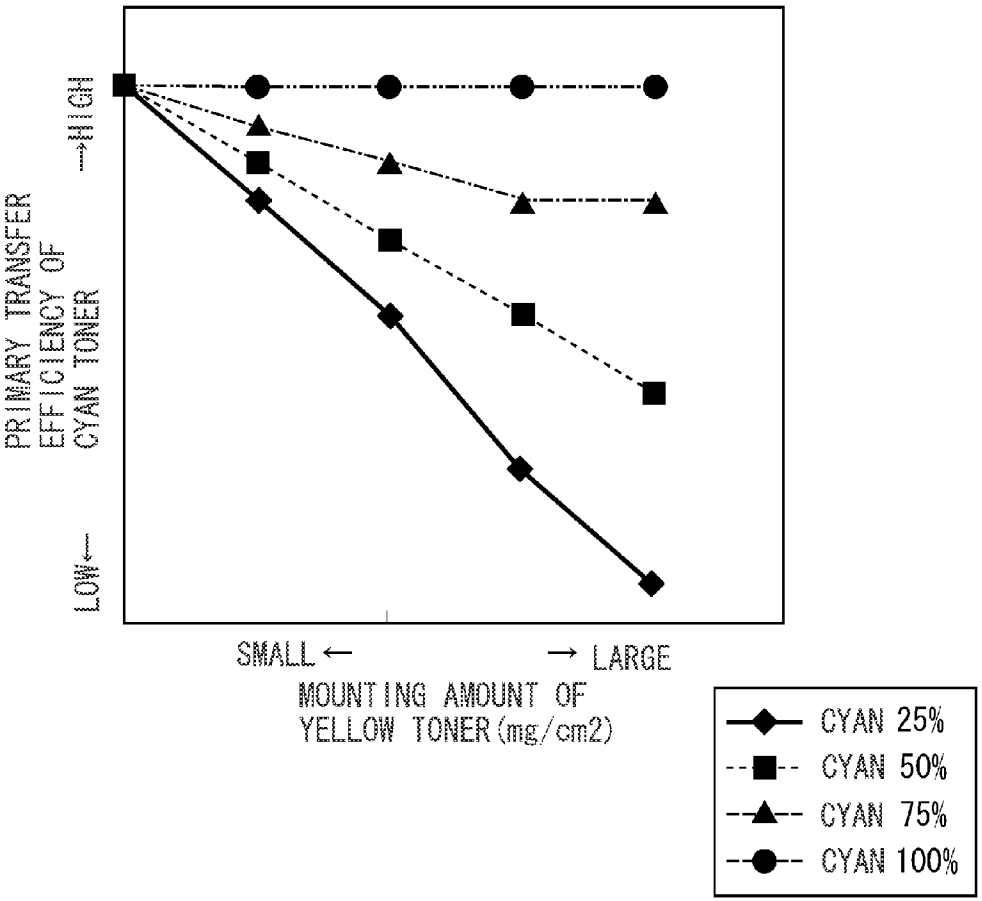
FIG. 6 illustrates a correlation between a transfer efficiency of a second color toner and a measure of consumption of the second cartridge with respect to a mounting amount of a first color toner.

The change in the primary transfer efficiency with respect to the cartridge life detected as described above will be described below. FIG. 6 illustrates the primary transfer efficiency of the cyan toner against the mounting amount of the yellow toner. Referring to FIG. 6, data acquired when the life of the cyan cartridge is 25%, 50%, 75%, and 100% are plotted. The life of the yellow cartridge used in the example is close to the brand new state. As the life of the cyan cartridge becomes closer to 0% and as the mounting amount of the yellow toner, i.e. the first color, increases, the primary transfer efficiency of the cyan toner is greatly deteriorated.

As described above, when the cartridge life detected by the detection unit is a second life which is a more consumed state as compared to a first life, the control unit controls the first toner forming unit and the second toner forming unit as follows. The control unit controls so that a difference between an amount of toner per unit area of the toner image corresponding to the maximum density image to be formed on the second image bearing member and an amount of toner per unit area of the toner image corresponding to the maximum density image to be formed on the first image bearing member becomes greater than the difference when the cartridge life is the first life.

Figure 7:
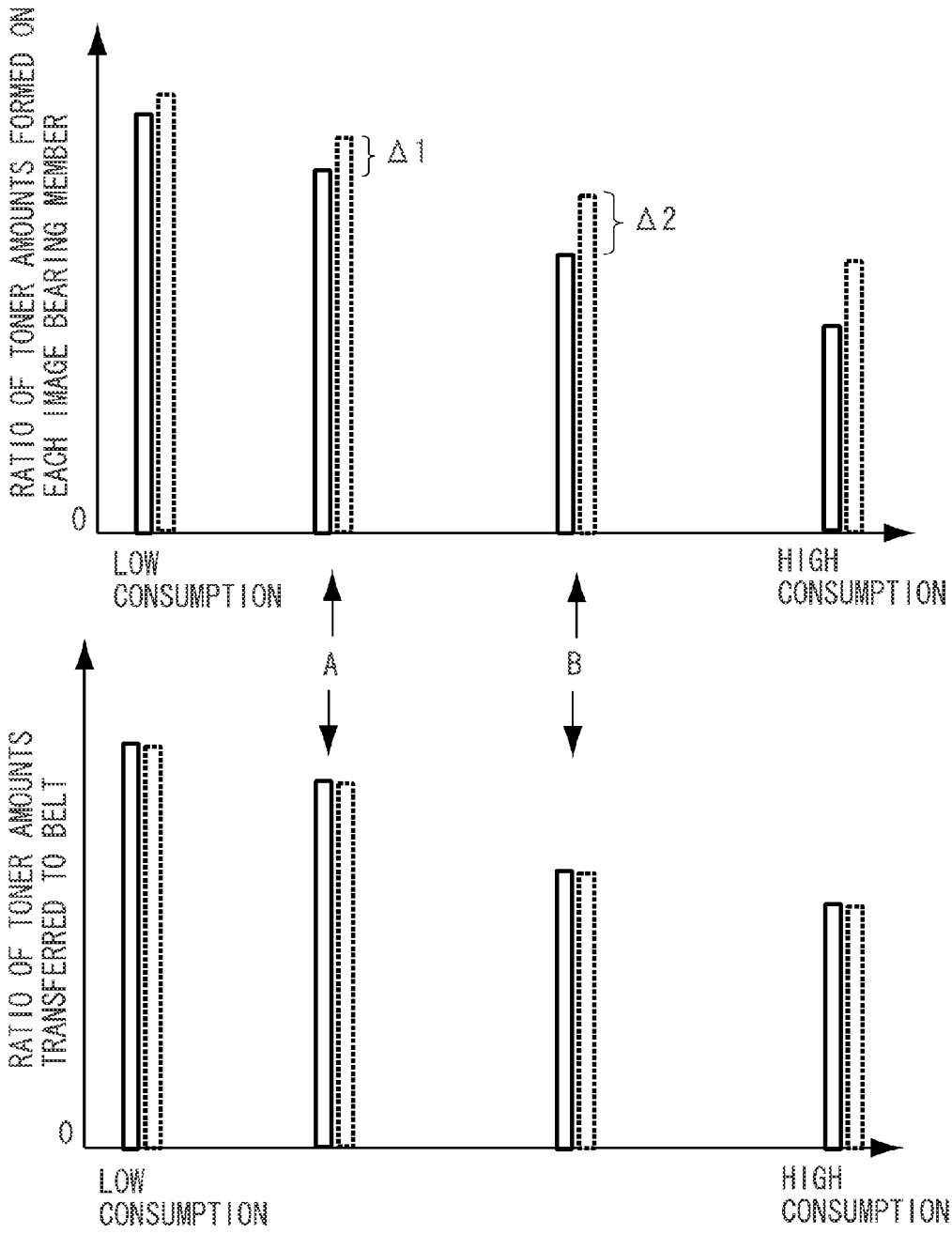
FIG. 7 is a correlation diagram illustrating a ratio of amounts of toners transferred to a belt and a difference between the toner mounting amounts with respect to a degree of consumption of the cartridge.

FIG. 7 illustrates a correlation between a ratio of the difference in the toner mounting amounts (A) and a ratio of the toner amounts transferred to the belt. The measure of consumption of the process cartridge, i.e. the cartridge life, is indicated on the horizontal axis. Positions indicated by arrows A illustrated in FIG. 7 indicate that the cartridge life is the first life, and positions indicated by arrows B indicate that the cartridge life is the second life. As illustrated in FIG. 7, when the control unit increases the difference between the mounting amounts of the toners according to the cartridge life, the difference in the toner mounting amounts at the time B (Δ2) becomes greater than the difference in the toner mounting amounts at the time A (Δ1). As a result, the ratios of the amounts of toners transferred to the belt corresponding to the time A and the time B become approximately equal regardless of the cartridge life.

Figure 8:
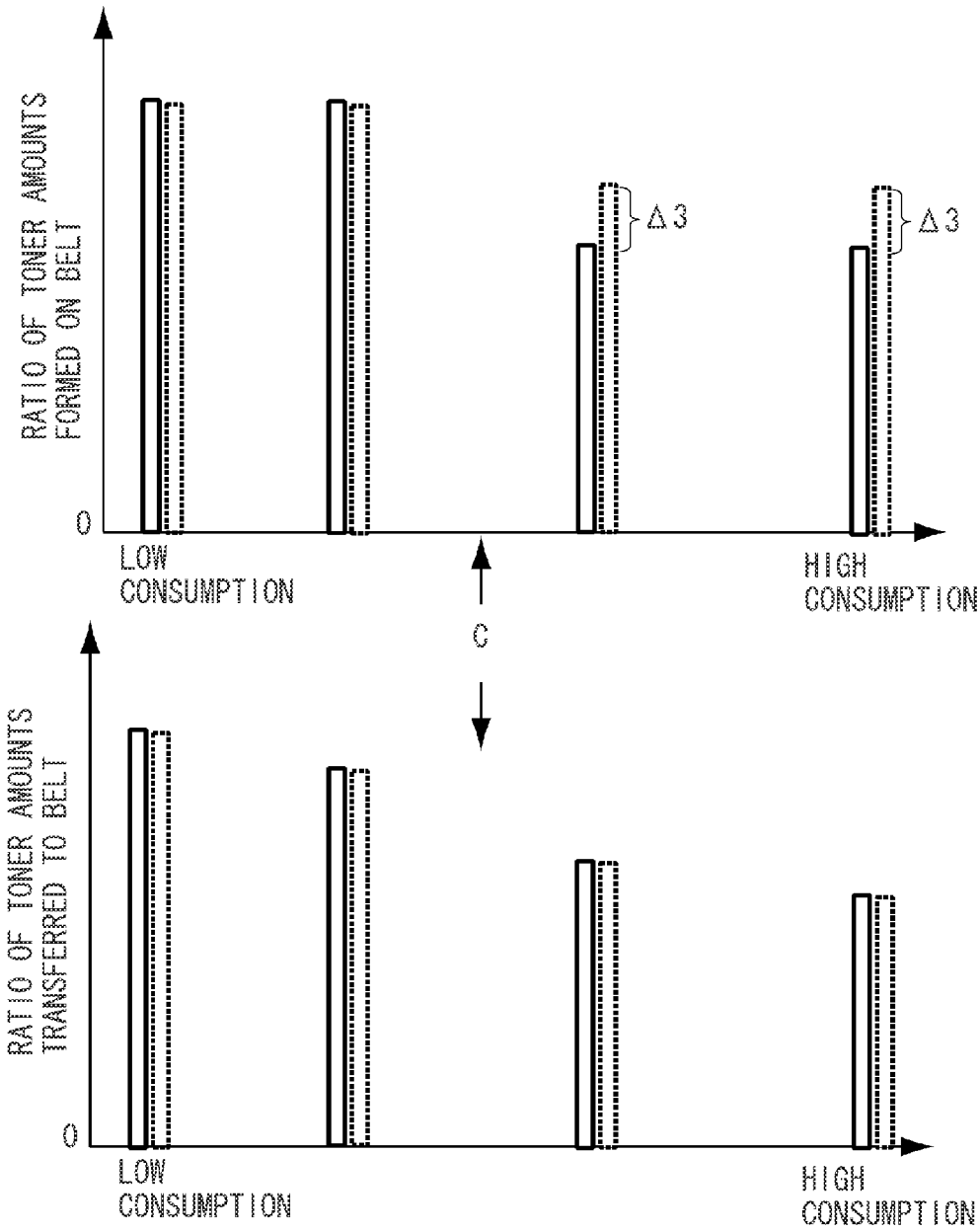
FIG. 8 is a correlation diagram illustrating a ratio of amounts of toners transferred to a belt and a difference between the toner mounting amounts with respect to a degree of consumption of the cartridge.

Further, referring to FIG. 8, if the cartridge life exceeds a predetermined cartridge life (i.e. positions indicated by arrows C illustrated in FIG. 8), the control unit may perform control as follows. The control unit may control the difference between the amount of toner per unit area of the toner image corresponding to the maximum density image to be formed on the second image bearing member and the amount of toner per unit area of the toner image corresponding to the maximum density image to be formed on the first image bearing member to be greater than the difference when the cartridge life does not exceed the predetermined cartridge life. When the cartridge life is in a comparatively early stage, the transfer efficiency of the second color toner is higher than or equal to a predetermined value, regardless of the mounting amount of the first color toner. The density unevenness is thus hardly generated. As illustrated in FIG. 8, the visible density unevenness can be reduced by controlling the difference in the toner amounts to be large at timing when the density unevenness becomes easily generated (i.e. when the cartridge life reaches 50% according to the present exemplary embodiment).

As described above, according to the first exemplary embodiment, the difference between the mounting amounts of the yellow toner and the cyan toner is changed according to the life of the cyan cartridge, i.e. the second color. As a result, the primary transfer efficiencies of the two colors can be improved while maintaining a good balance in color reproducibility. Further, the density unevenness can be reduced when the maximum density image of the secondary color is formed.

According to a second exemplary embodiment, the basic configuration of the image forming apparatus to which the present invention is applicable is similar to that of the first exemplary embodiment. The elements having the function and configuration which are the same or correspond to those of the first exemplary embodiment will be assigned the same reference numbers, and detailed description will be omitted.

According to the first exemplary embodiment, the cartridge life of the second color toner is used to determine the difference between the mounting amounts of the first color toner and the second color toner. According to the present exemplary embodiment, the difference between the mounting amounts of the first color toner and the second color toner is determined using information about the cartridge lives of both the first color toner and the second color toner.

Figure 9:
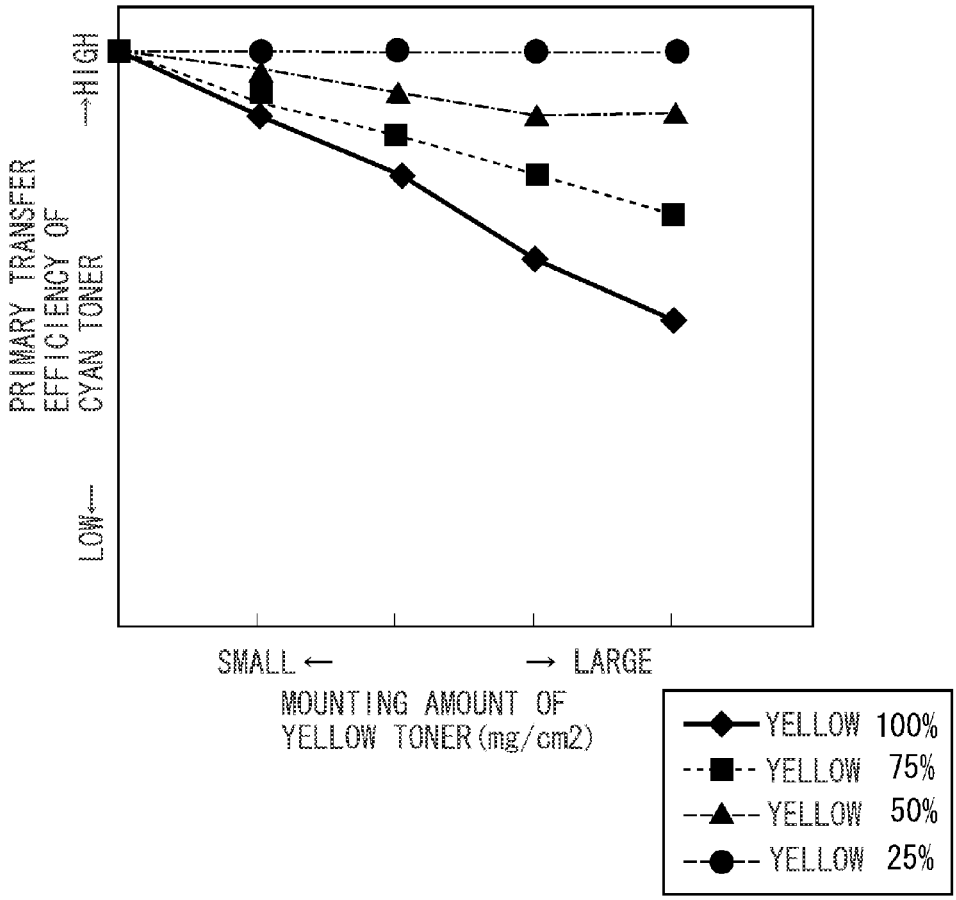
FIG. 9 illustrates a correlation between a transfer efficiency of amount of the second color toner and a measure of consumption of the first cartridge with respect to a mounting amount of a first color toner.

An example in which the maximum density image of the green color, i.e. the secondary color, is formed similarly as in the first exemplary embodiment will be described below. FIG. 9 illustrates the primary transfer efficiency of the second color toner with respect to the mounting amount of the first color toner. Referring to FIG. 9, the data acquired when the cartridge life of the yellow toner is 25%, 50%, 75%, and 100% are plotted. The cartridge life of the cyan toner is close to 0%.

As illustrated in FIG. 9, when the cartridge life of the yellow toner is close to the brand new state, the primary transfer efficiency of the cyan toner is greatly affected by the mounting amount of the yellow toner. In other words, when the cartridge life of the yellow toner is close to the brand new state, the primary transfer efficiency of the cyan toner is greatly lowered as the mounting amount of the yellow toner increases. It is considered that the negative charge amount of the yellow toner is large when the cartridge life of the yellow toner is close to the brand new state, so that an effect to weaken the electric field for primary transferring the cyan toner is large.

In contrast, when the cartridge life of the yellow toner is close to reaching 0%, the negative charge amount of the yellow toner is small, so that the effect of the yellow toner on the primary transfer efficiency of the cyan toner is small. As a result, the control unit controls the difference between the mounting amounts of the first color toner and the second color toner by determining from both the cartridge lives of the yellow toner and the cyan toner.

An example of determining the difference between the mounting amounts of the first color toner and the second color toner from the cartridge lives of both the first color (yellow) and the second color (cyan) is illustrated in Table 1 described below.

TABLE 1

| | Cyan cartridge life | | | | |
|---|---|---|---|---|---|
| | 100% | ~75% | ~50% | ~25% | ~0% |
| Yellow mounting amount when yellow cartridge life is 100% | 100% | 95% | 90% | 85% | 80% |
| Yellow mounting amount when yellow cartridge life is 70% | 100% | 95% | 90% | 85% | 85% |
| Yellow mounting amount when yellow cartridge life is 50% | 100% | 95% | 95% | 90% | 85% |
| Yellow mounting amount when yellow cartridge life is 25% | 100% | 95% | 95% | 90% | 90% |

As described above, according to the present exemplary embodiment, the difference between the mounting amounts of the first color toner and the second color toner is changed by determining from the cartridge lives of both the yellow toner and the cyan toner. Thus, the primary transfer efficiencies of the two colors can be improved while maintaining a good balance in color reproducibility, and the density unevenness can be reduced when the maximum density image of the secondary color is formed.

According to the above described exemplary embodiments, the secondary color image in the green color that is the most noticeable is used as an example. However, the present invention is not limited to the above example and is effective in forming images using any secondary color.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-149065 filed Jun. 23, 2009, which is hereby incorporated by reference herein in its entirety.

What is claimed is:

1. An image forming apparatus which can detachably mount a cartridge that includes at least an image bearing member configured to bear a toner image and a toner forming unit configured to form the toner image on the image bearing member therewith, the image forming apparatus comprising:

a rotatable intermediate transfer belt;

a first cartridge which includes at least a first image bearing member configured to bear a toner image and a first toner forming unit configured to form the toner image on the first image bearing member;

a second cartridge which includes at least a second image bearing member configured to bear a toner image and a second toner forming unit configured to form the toner image on the second image bearing member;

a control unit configured to control the first toner forming unit and the second toner forming unit to control a toner amount per unit area of a toner image corresponding to a maximum density image respectively formed on the first image bearing member and the second image bearing member, wherein the toner image from the second image bearing member is transferred onto the toner image transferred from the first image bearing member to the intermediate transfer belt, and the toner images superposed on the intermediate transfer belt is transferred to a transfer material; and a detection unit configured to detect a measure of consumption of the second cartridge, and wherein the control unit controls, when the measure of consumption detected by the detection unit is a second measure of consumption which is in a consumed state more than a first measure of consumption, the first toner forming unit and the second toner forming unit so that a difference in a toner amount, acquired by subtracting the toner amount per unit area of the toner image corresponding to the maximum density image formed on the first image bearing member from the toner amount per unit area of the toner image corresponding to the maximum density image formed on the second image bearing member, becomes greater than a difference between the toner amounts those of when a detected measure of consumption is the first measure of consumption.

2. The image forming apparatus according to claim 1, wherein the second measure of consumption is a predetermined value of measure of consumption, and the control unit controls the first toner forming unit and the second toner forming unit so that the difference in the amounts of the toners becomes zero before a value detected by the detection unit reaches the predetermined value.

3. The image forming apparatus according to claim 1, wherein the first toner forming unit includes a first exposure unit configured to expose the first image bearing member, a first charging unit configured to charge the first image bearing member, and a first developing unit configure to develop the first image bearing member, and wherein the second toner forming unit includes a second exposure unit configured to expose the second image bearing member, a second charging unit configured to charge the second image bearing member, and a second developing unit configure to develop the second image bearing member.

4. The image forming apparatus according to claim 3, wherein the control unit changes a developing amount of the first developing unit with respect to the first image bearing member, and a developing amount of the second developing unit with respect to the second image bearing member.

5. The image forming apparatus according to claim 3, wherein the second developing unit includes a toner container configured to contain a toner, and a developing roller configured to bear and convey the toner, wherein the detection unit includes a first detection member configured to detect a total number of rotations of the developing roller, and a second detection member configured to detect a remaining amount of the toner in the toner container, and the detection unit detects a measure of consumption of the second cartridge from detection results of the first detection member and the second detection member.

6. The image forming apparatus according to claim 3, wherein the first developing unit develops a yellow color toner.

* * * * *